US006354765B2

(12) United States Patent
Jones

(10) Patent No.: US 6,354,765 B2
(45) Date of Patent: Mar. 12, 2002

(54) METHOD OF TRANSPORTING AND DISPOSING OF AN OFFSHORE PLATFORM JACKET

(75) Inventor: John Arthur Jones, Houston, TX (US)

(73) Assignee: ExxonMobile Upstream Research Company, Houston, TX (US)

( * ) Notice: Subject to any disclaimer, the term of this patent is extended or adjusted under 35 U.S.C. 154(b) by 0 days.

(21) Appl. No.: 09/764,923

(22) Filed: Jan. 18, 2001

Related U.S. Application Data

(60) Provisional application No. 60/182,663, filed on Feb. 15, 2000.

(51) Int. Cl.[7] ..... E02B 17/08; E02D 29/00

(52) U.S. Cl. ..... 405/203; 405/195.1; 405/209; 114/258

(58) Field of Search ..... 405/195.1, 203, 405/206, 209, 222, 223, 224; 114/223, 258, 259, 264–267

(56) References Cited

U.S. PATENT DOCUMENTS

| | | | | | |
|---|---|---|---|---|---|
| 3,859,806 | A | | 1/1975 | Guy et al. | 405/204 |
| 4,252,468 | A | | 2/1981 | Blight | 405/204 |
| 4,683,832 | A | * | 8/1987 | Dysarz | 114/258 |
| 4,690,586 | A | | 9/1987 | Oksuzler | 405/209 |
| 4,927,296 | A | * | 5/1990 | Kaldenbach | 405/206 |
| 5,097,786 | A | | 3/1992 | Sheffield | 114/258 |
| 5,800,093 | A | | 9/1998 | Khachaturian | 405/204 |

FOREIGN PATENT DOCUMENTS

| | | | | |
|---|---|---|---|---|
| GB | 2170250 | | 7/1986 | |
| GB | 2187778 | * | 9/1987 | 405/195.1 |
| GB | 2190290 | | 7/1988 | 43/14 |

OTHER PUBLICATIONS

"Removal of Offshore Installations: An Industry Positions Paper," The Oil Industry International Exploration and Production Forum, Report No. 10.2/95 (May 1984).

"The Decommissioning of Offshore Installations: A Worldwide Survey of Timing, Technology and Anticipated Costs," The Oil Industry International Exploration and Production Forum, Report No. 10.5/108 (Dec. 1984).

(List continued on next page.)

*Primary Examiner*—Thomas B. Will
*Assistant Examiner*—Jong-Suk Lee
(74) *Attorney, Agent, or Firm*—Kelly A. Morgan

(57) ABSTRACT

A method for disposing of an offshore platform jacket comprises suspending the jacket in one piece under a tow vessel, towing it to the disposal site and safely and quickly releasing the jacket at the disposal site. Once the jacket foundation piles have been severed, the first end of the jacket is lifted using a derrick barge crane or winch connected to a first lift rigging device until the first lift rigging device engages with a first release device. The second end is lifted in a similar manner with a second lift rigging device and a second release device until the jacket is suspended substantially beneath the tow vessel. The lift rigging device include a spreader bar having at least one skid shoe attached thereto, at least two padeyes attached at opposite ends of the spreader bar, a lift sling attached to the padeyes and at least two jacket support slings. Each release device is attached to the tow vessel and includes at least one rocker beam having a connector. The rocker beam is adapted to pivot about a pivot point upon disengaging the connector. Once the jacket has been towed under the tow vessel to the disposal site, the connectors can be disengaged thus allowing each rocker beam to pivot and the jacket to be released.

12 Claims, 3 Drawing Sheets

OTHER PUBLICATIONS

Prasthofer, P.H., "Platform Decommissioning Issues and Considerations," Presentation of JOPDA Tokyo, Jun. 6, 1991.
Parker, M.E. and Henkhaus, E.J., "High Island A–343 "A" and "B": A Case History of Offshore Platform Abandonment", Society of Petroleum Engineers, Inc. SPE #19709, 1989, pp. 91–100.
Dysarz, Ed, "Practical New System for Platform Removal Unveiled,", Ocean Industry, 1985, pp. 49–50.
Hyden, A.M., "Offshore Facilities Removal–A Major Issue Now and for the Future," The Apea Journal, 1989, pp. 6–10.
Drury, Ian, "Platform Removal Men Look Ahead to N Sea Dismantling," Offshore Engineer, Dec. 1986, pp. 19–20.
Knott, David, "North Sea Operators Tackling Platform Abandonment Problems," Oil & Gas Journal, Mar. 1995, pp. 31–40.
Carr, T.N. et al., "Platform Removal Method for Larger Offshore Structures: Case Histories" Offshore Technology Conference, OTC #6780, May 1991, pp. 429–439.
"Amposta Affords Lessons for Deepwater Abandonment," Offshore Engineer, Mar. 1990, pp. 20–27.
Prasthofer, P.H. et al., "Recent Developments in Platform Decommissioning: An Operator's European Perspective," Offshore Technology Conference, OTC #5428, Apr. 1987, pp. 45–52.
Anastasio, F.L., "Ship–Mounted Fork Lift Remove 2,000–t Platforms," Ocean Industry, May 1989, pp. 30–32.
Moritis, Guntis, "Industry Tackles Offshore Decommissioning," Oil & Gas Journal, Dec. 1997, pp. 33–36.
Twachtman, Ron, "Offshore–Platform Decommissioning Perceptions Change," Oil & Gas Journal, Dec. 1997, pp. 38–41.
Griffin Jr., W.S. "Disposal of Disused Offshore Platforms," Phillips Petroleum Compnay, pp. 1–24, Undated.
Sawyer, G.H., "Platform De–Commissioning: A Contemporary Issue," Offshore Technology Conference, OTC #5076, May 1985, pp. 1–8.
Hoyle, B.J., "International Standards For Removal Of Abandoned And Disused Offshore Oil Production Platforms," Offshore Technology Conference, OTC #5932, May 1989, pp. 503–509.
"Standardized Platform Removal Equipment Can Cut Costs and Time," Offshore, 1989, pp. 76–79.
Pittard, Ashley, "Governments Grapple With Abandonment Fiscal Terms," Oil & Gas Journal, Dec. 1997, pp. 42–46.
Bourgon, J.M. Martin, et al., "Abandonment and Removal of Steel Platforms", The European Oil and Gas Conference, Grahma & Trotman, 1990, pp. 282–283.
"Draft Report to the Maritime Safety Committee," International Maritime Organization, Feb. 1988.
"From Production Platforms to Artificial Reefs,"Offshore Engineer, Sep. 1990, pp. 26–27.
Barlett, T.W., "Deconstruction of an Offshore Platform," Offshore Technology Conference #7481, May 1994, pp. 123–130.
Gurney, Judith, "Abandonment of Offshore Rigs : Experience in the Gulf of Mexico," Petroleum Review, May 1992, pp. 237–239.
Wilkinson, Max, "A 6 Bn Pounds (Pds) Demolition Job: North Sea Oil Platforms," London Financical Times Editorial, 1986, pp. 18.
Prasthofer, P.H., "Platform Decommissioning.: Look Toward the Future," Ocean Industry, May 1989, pp. 24–27.

* cited by examiner

METHOD OF TRANSPORTING AND DISPOSING OF AN OFFSHORE PLATFORM JACKET

This application claims the benefit of U.S. Provisional Application No. 60/182,663 filed Feb. 15, 2000.

FIELD OF THE INVENTION

This invention relates generally to the field of abandonment of offshore structures. More specifically, the present invention is a method for disposing of a large steel jacket structure in one piece by suspending the jacket under a tow vessel, towing the jacket to a disposal site, and safely and quickly releasing the jacket at the disposal site.

BACKGROUND OF THE INVENTION

When an offshore oil or gas reservoir is depleted and is no longer economical to produce, an alternative use must be found for the platform or it must be decommissioned. Offshore platform decommissioning will become an increasing problem for the international oil and gas industry as many of the early fields are coming toward the end of their lives. There are currently about 7000 offshore platforms in existence worldwide. These platforms range from small wellhead structures weighing only tons or at most a few hundred tons to large multi-well steel or concrete structures weighing tens of thousands of tons. They are located in water depths ranging from only a few meters to about 150 meters, with a small number in depths around 300 meters.

Many offshore platforms have already been abandoned. To date most have been relatively small platforms located in shallow water. With smaller platforms, the piles can be cut below the mudline and the jacket can be lifted in one piece and either returned to shore for scrapping, returned to shore for refurbishment and reuse, or transported to a shallow water artificial reef site. However with platforms located in deeper water, the problem of how to remove, transport, and dispose of the larger substructure jacket becomes more difficult and the associated costs increase.

There are several options for decommissioning an offshore platform at the end of a producing field's life including: (1) leaving the platform in-situ (e.g., artificial reef or abandoned with suitable navigational markings); (2) partial removal of the platform; and (3) complete removal of the platform. The technical feasibility of the option used will depend on physical properties specific to each platform including: water depth, location, physical condition, size, weight, buoyancy, structural configuration and structural integrity. As water depth and jacket sizes increase the major cost components of removal of large steel or concrete structures increase because of high barge and crane costs, time spent offshore, and abandonment of equipment.

It is almost always possible to cut the steel jacket into sections which are small enough to be handled with the available offshore lift vessels. However, this may be a very expensive solution. In order to cut a large steel structure into pieces that are liftable, many large diameter jacket legs and diagonal braces must be cut underwater. This cutting can be done for example with explosives, divers using torches or abrasive cutters. The major drawbacks to using this method are that it is time consuming and the multiple underwater cutting required considerably increases the risks to divers and equipment. For very large structures, the time and costs associated with piecemeal removal go up due to the increase in the number of pieces to be removed. In very deep water, the costs could be significantly impacted due to the increased problems with working at depth. Also, because the rental rates for the support equipment such as derrick barges and dive support vessels are quite high, these long duration cutting activities greatly increase the cost of removal.

Assuming that disposing of the jacket in-situ will be a viable disposal option for only a limited number of platforms, the least expensive option for many others may be to refloat the jacket in one piece by means of internal and auxiliary buoyancy and then to tow the structure to deep water for disposal. The primary ways to provide the required auxiliary buoyancy are to lift the jacket with a derrick barge or attach some form of auxiliary buoyancy device to the jacket. This auxiliary buoyancy device could be a steel tank, a steel buoyancy tube installed in a skirt pile guide, an inflatable rubber lift bag, or a vessel such as a barge or boat. The methods involving auxiliary buoyancy tanks are usually expensive because the tanks are very large and will likely not be reusable on other projects. When a derrick barge or other rented vessel is used to provide the needed auxiliary buoyancy; there is also the problem of how to release the jacket from the vessel. With a derrick barge, it is not possible to design a quick release of the vessel load from the crane hook because of the danger that the rebound of the crane boom would cause the boom to buckle and fail. If the jacket is attached to a barge or other vessel, the problem of release still exists: because the attachment has to be strong enough to hold the structure during the tow, it becomes difficult to devise a quick release method that will reliably and quickly release such large connections.

While current methods of jacket removal may be adequate for removal of smaller jackets, the cost of removal is expected to rise dramatically in the future with more larger structures reaching the end of their operational lives. These circumstances necessitate a simpler and more cost-effective method of conducting platform removal operations. Therefore, it would be desirable to have a method for transporting and disposing of a jacket which allows for a safe and quick release of the jacket. The present invention satisfies this need.

SUMMARY OF THE INVENTION

The present invention is a method of transporting an offshore platform substructure, commonly known as a "jacket", from a first offshore location to a second offshore location for release at the second location. The method uses a floating vessel, such as a barge, that has at least two release means attached to corresponding first and second ends of the vessel. Each of the release means is adapted to pivot about a pivot point located outboard of the vessel. A first lift rigging means is used to lift the first end of the jacket until the first lift rigging means engages with the first release means at a position outboard from but proximate to the pivot point of the first release means. A second lift rigging means is attached to a second end of the jacket, and the second-end of the jacket is lifted until the second lift rigging means engages with the second release means at a position outboard from but proximate to the pivot point of the second release means. Thus the jacket is suspended substantially under the vessel. The vessel is then moved to the second offshore location, and the first and second release means are activated, which allows each of the release means to pivot about their respective pivot points and release the jacket.

Each of the lift rigging means can be comprised of a spreader bar having at least one skid shoe attached thereto. At least two padeyes are attached at opposite ends of the spreader bar and a lift sling is attached to each of the padeyes. At least two jacket support slings are attached to the spreader bar. Each of the release means can be comprised of one rocker beam having a release-end and a connector located at the release-end. The connector is used to attach the rocker beam to the vessel, and the rocker beam is adapted to pivot about the pivot point upon disengaging the connector.

BRIEF DESCRIPTION OF THE DRAWINGS

For a better understanding of the present invention, reference may be made to the accompanying drawings, in which.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which may be included within the spirit and scope of the invention, as defined by the appended claims.

DETAILED DESCRIPTION OF THE INVENTION

Figure 2:
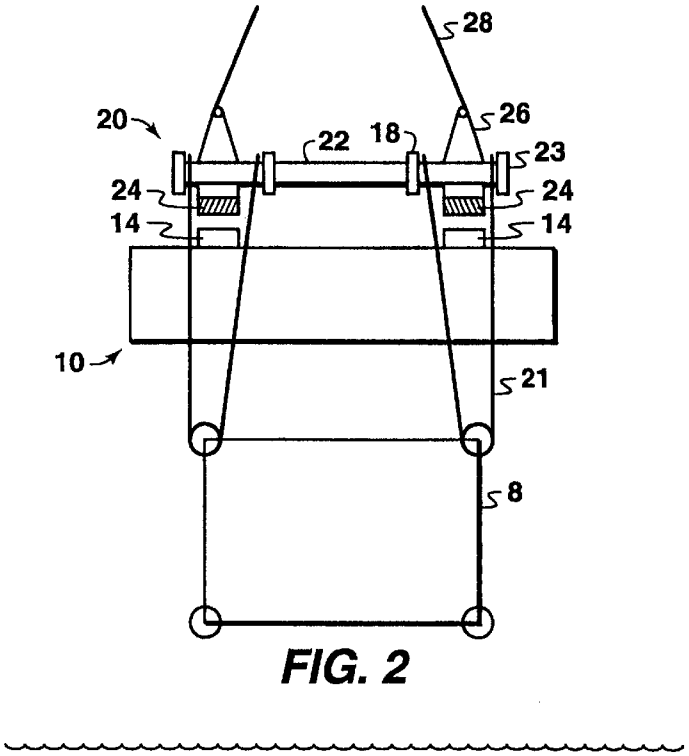
FIG. 2 is an end view of a release means attached to the vessel with the lift rigging means attached to the jacket.

Referring now to FIGS. 1 and 2, the present invention is a method of transporting an offshore platform substructure, commonly known as a "jacket" 8, which allows the jacket 8 to be transported to another location in one piece. The jacket 8 is suspended substantially beneath a floating vessel 10, such as a modified cargo or launch barge, and is then moved to the second offshore location for release. The invention utilizes a floating vessel 10 with release means 12 fitted on first and second ends of the vessel 10. A lift rigging means 20, which is illustrated in FIG. 2, includes a spreader bar 22, which is fitted with skid shoes 24 that act as a skid frame during release of the jacket 8. The skid shoes 24 support the jacket 8 during transport and provide a sliding surface during release of the jacket 8. The spreader bar 22 also has at least two jacket support slings 21 to support the jacket 8, as well as at least two padeyes 26, attached at opposite ends of the spreader bar 22. A lift sling 28 is attached to the padeyes 26, which are used with a crane to lift the jacket 8.

Referring again to FIG. 1A, there are two release means 12 fitted on the vessel 10. In a preferred embodiment, as illustrated in FIG. 1B, the release means 12 has two rocker beams 14 (only one shown in FIG. 1B) that are attached by one or more connectors 16 located at the release-end of each rocker beam 14, which is generally at the far in-board end of rocker beam 14. Each release means 12 is adapted to pivot about a pivot point 11. Each rocker beam 14 is prevented from rotating about pivot point 11 by connector 16, which can be a steel shear plate, explosive bolts or other mechanical connector. Such release means 12 serve the dual function of supporting the suspended jacket 8 during transport and, as described further below, are also the primary component used to affect the release of the jacket 8 once at the disposal site.

A preferred embodiment of lift rigging means 20 is illustrated in FIG. 2. Lift rigging means 20 includes connections for the jacket support slings 21. These connections are preferably simple (e.g., such as a sling loop placed over a padear 23) because two of the connections may have to be made up underwater by ROV's or divers. The spreader bar 22 will also have connectors for the lift slings 28 to connect to the crane or winches used to lift the jacket 8 into position. These connections can be more conventional (i.e., padeyes 26 and shackles) as they will likely be attached and removed above water. The spreader bar 22 has a skid shoe 24 arrangement, comprised of at least one skid shoe attached to the spreader bar 22, to carry the weight of the jacket 8 during transport and also to provide a sliding surface to carry the jacket support slings 21 off the rocker beams 14 after the release means 12 has been activated. Timber on the bottom of the skid shoes 24 (two skid shoes illustrated in FIG. 2) can act to help evenly distribute the load from the jacket support slings 21 to the rocker beams 14.

Figure 4:
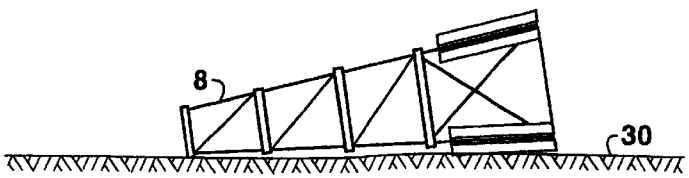
FIG. 4 illustrates the jacket toppled to a horizontal position on the sea floor.
Figure 3:
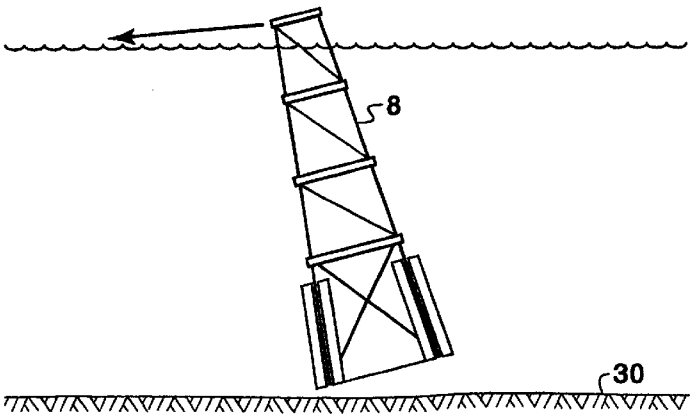
FIG. 3 illustrates the jacket being toppled.

FIGS. 3 through 12 illustrate how the jacket 8 can be suspended under the vessel 10 and transported to and released at a disposal site. Generally, the method progresses as follows. The deck structure (not shown) is first removed from the platform jacket 8 using conventional means. The foundation piles of the jacket 8 are then severed and, as illustrated in FIGS. 3 and 4 the jacket 8 is toppled onto its side on the seafloor 30. A first lift rigging means 20 is attached to the first end of the jacket 8 typically before toppling and a second lift rigging means 20 is attached to the second end before or after toppling. The jacket 8 can be toppled by pulling on the top of the jacket 8 with a tug, with barge mounted winches, or with alternate lifting and pulling by a derrick barge.

Figure 1A:
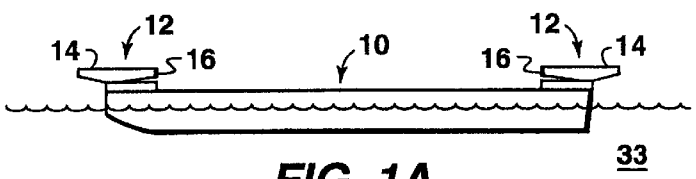
FIG. 1A illustrates a vessel having two release means connected at first and second ends.
Figure 1B:
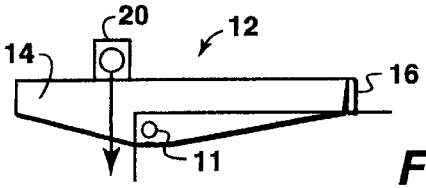
FIG. 1B illustrates the release means depicted in FIG. 1A.
Figure 6:
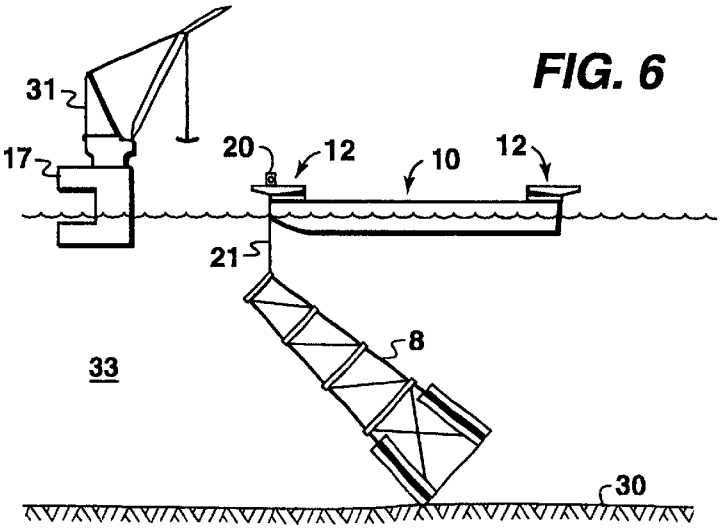
FIG. 6 illustrates the first lift rigging means engaged with the first release means and the barge released from the rigging means.
Figure 5:
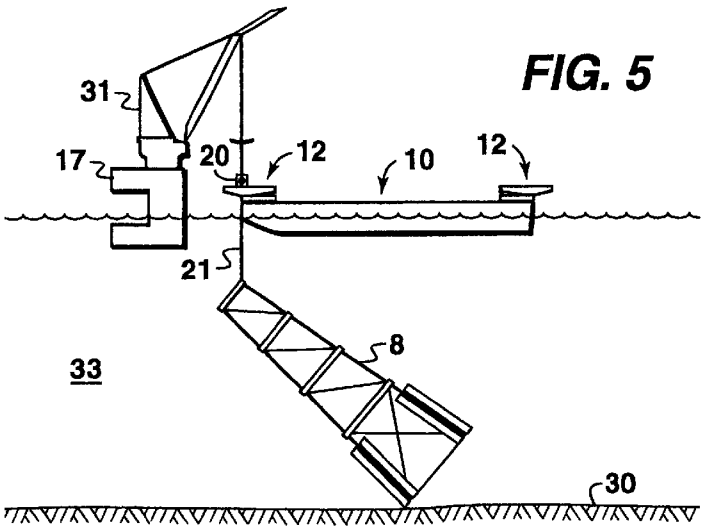
FIG. 5 illustrates the first end of the jacket being lifted with the first lift rigging means onto the first release means.

Referring now to FIG. 5, with the jacket 8 lying on its side on the seafloor 30, the first end of the jacket 8 is then lifted with a crane or winch 31 (mounted on a derrick barge 17) attached to the first lift rigging means 20, until the first lift rigging means 20 engages with the first release means 12 at a position outboard from but proximate the pivot point 11 of the first release means 12 (see FIG. 1A). More specifically, the first lift rigging means 20 is lifted until the spreader bar 22 (illustrated in FIG. 2) is out of the water 33. The vessel 10 is then positioned so that the skid shoes 24 on the first lift rigging means 20 can be set down on the rocker beams 14 on one end of the vessel 10. The skid shoes 24 are positioned just outboard of the pivot point 11 of the rocker beams 14. The rocker beams 14 are prevented from rotating by connector 16, which could be a shear plate, bolt, or other mechanical connector. As shown in FIG. 6, with the rocker beams 14 supporting the weight of the jacket 8, the crane or winch 31 is released and the derrick barge 17 is then maneuvered to the other end of the vessel 10 to lift the second end of the jacket 8.

Figure 8:
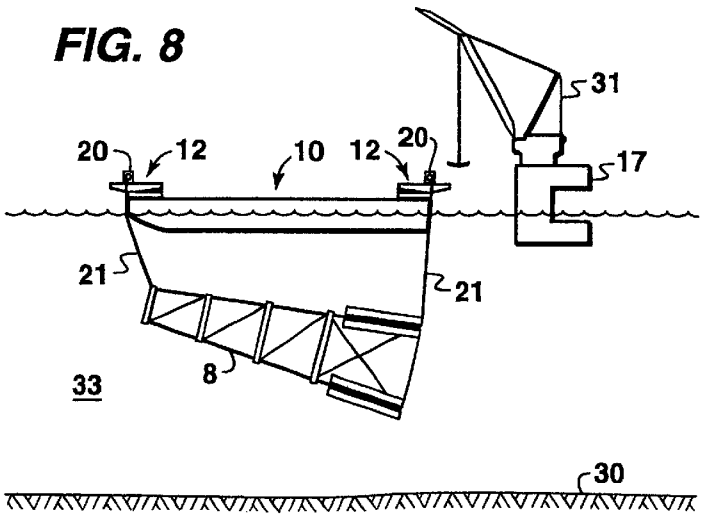
FIG. 8 illustrates the second lift rigging means engaged with the second release means and the barge released from the second lift rigging means.
Figure 7:
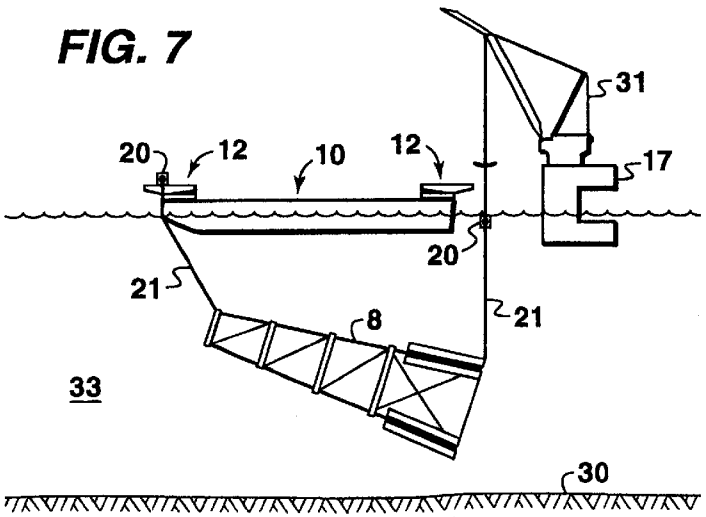
FIG. 7 illustrates the second end of the jacket being lifted with the second lift rigging means onto the second release means.
Figure 9:
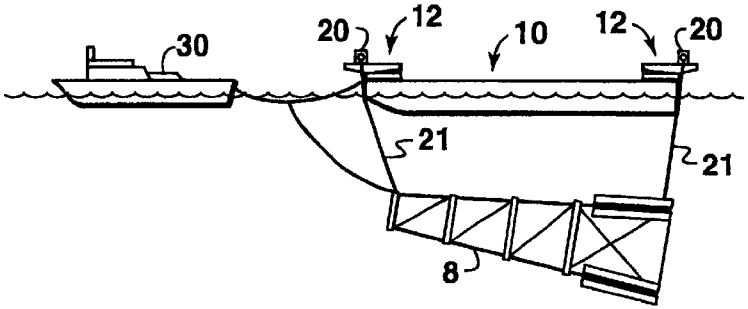
FIG. 9 illustrates the jacket suspended generally beneath the barge for towing to the second offshore location.

As illustrated in FIGS. 7 and 8, the second lift rigging means 20 is attached to the second end of the jacket 8. More specifically, jacket support slings 21 are attached to the bottom end of the jacket 8, if not already done so in previous stages of undersea operation. The second end of the jacket 8 is raised in the same manner as the first end by setting the skid shoes 24 on the rocker beams 14 just outboard of the pivot point 11 of the rocker beams 14. It may be necessary to set bow anchors on the vessel 10 and attach tugs to bottom end of the jacket 8 in order to allow the crane 31 to lift the bottom end of the jacket 8 and still clear the rocker beams 14 on the vessel 10. The rocker beams 14 now support the weight of the jacket 8, and the spreader bar 22 can be released by the crane or winch 31 and seafastened. As illustrated in FIG. 9, this now leaves the jacket 8 suspended substantially beneath the vessel 10 for towing by tow vessel 30 to the disposal site.

Figure 10:
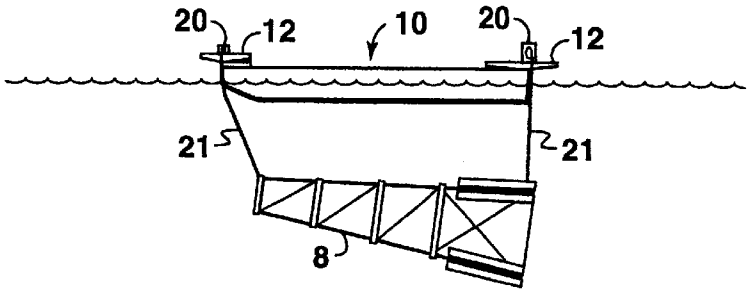
FIG. 10 illustrates activation of the first and second release means.
Figure 12:
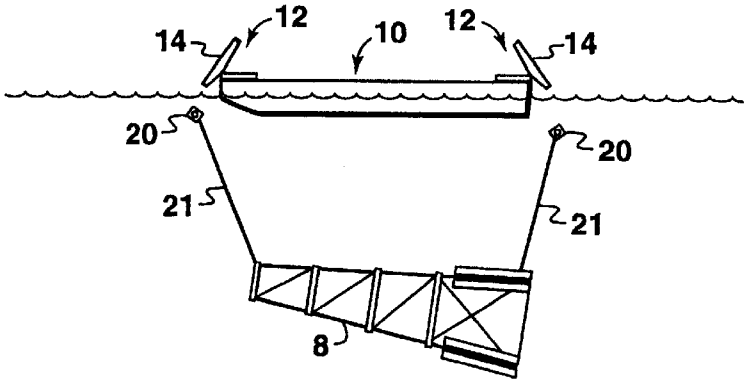
FIG. 12 illustrates the jacket released from the vessel.
Figure 11:
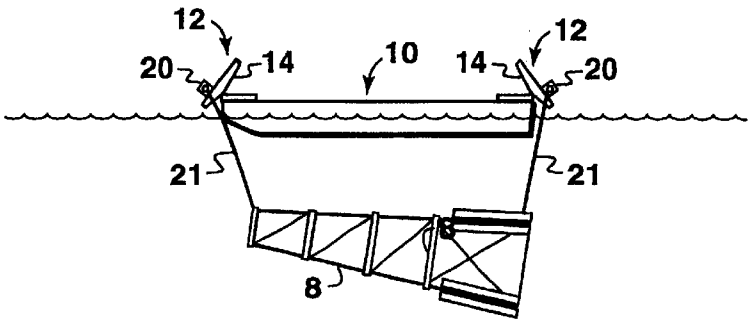
FIG. 11 illustrates each of the release means pivoting about their respective pivot points.

FIGS. 10 through 12 illustrate disposal of the jacket 8 at a second offshore location. Once at the disposal site, the seafastening is removed and the jacket 8 is prepared for release. As illustrated in FIG. 10, the release means 12 are activated by allowing the rocker beams 14 to tilt and the spreader bars 22 to slide off. The connector 16 can include: steel shear plates, which may be severed by shaped explosive charges; bolts, which may be activated with explosive bolts; or a mechanical connector which may be activated by a quick release mechanism incorporated into it. As shown in FIGS. 11 and 12, activating the first and second release means 12 allows the rocker beams 14 to pivot about their respective pivot points 11 and thus release the jacket support slings 21 and the jacket 8. All release means 12 should be released generally simultaneously if the jacket 8 is being disposed of in water of a depth greater than that from which it was removed. This will prevent damage to the vessel 10.

The advantage of using rocker beams 14 for the support and release mechanism of release means 12 is that they are a standard piece of hardware readily available within the offshore market, and they are available in many sizes in order to accommodate a range of jacket weights. They also offer a substantial mechanical advantage, which is desired for such a quick release mechanism. In trying to quickly release a very large load, it is preferable to have a mechanical advantage which allows a relatively small connector to be released which, in turn, releases the large load. Referring to FIG. 1B, it can be seen that this mechanical advantage is accomplished by placing the load on the skid shoes 24 proximate to the pivot point 11 of the rocker beam 14. The connector 16 which prevents rotation is preferably placed at the far in-board end of the rocker beam 14 such that a large mechanical advantage is obtained which allows the connector 16 to be much smaller than it would have to be if it carried the entire weight of the jacket 8.

This inventive technique of transporting and disposing of a large steel jacket 8 will have the greatest application when the distance from the jacket 8 site to the deepwater disposal site is not too great. The jacket 8 suspended generally underneath the vessel 10 will cause the tow resistance to be quite large and will likely result in rather slow towing speeds. A shorter tow will also likely allow the environmental tow criteria to be reduced as the exposure time is reduced.

The primary incentives for use of this inventive method are cost reduction and commercialization of existing or new fields. By refloating the jacket 8 in one piece, very expensive underwater work and many days of expensive heavy-lift derrick barge time can be eliminated. Also, by being able to rent the auxiliary buoyancy (e.g., vessel 10) rather than having to buy it in the form of purpose—built floatation tanks, the cost of removal can be greatly reduced. This savings can be a significant factor in the economics of an existing structure late in its life or as a consideration in whether to develop a marginal new field.

It should be understood that the foregoing description is illustrative and that other embodiments of the invention can be employed without departing from the full scope of the invention as set forth in the appended claims.

I claim:

1. A method of transporting an offshore platform jacket from a first offshore location to a second offshore location, said method comprising the steps of:

providing a floating vessel having first release means attached to first end of said vessel and second release means attached to second end of said vessel; each of said release means adapted to pivot about a pivot point located outboard of said vessel;

attaching a first lift rigging means to a first end of said offshore platform jacket;

lifting said first end of said offshore platform jacket until said first lift rigging means engages with said first release means at a position outboard from but proximate to said pivot point of said first release means;

attaching a second lift rigging means to a second end of said offshore platform jacket;

lifting said second-end of said offshore platform jacket until said second lift rigging means engages with said second release means at a position outboard from but proximate to said pivot point of said second release means, whereby said offshore platform jacket is suspended substantially under said floating vessel;

moving said floating vessel to said second offshore location; and activating said first and second release means, whereby each of said release means pivots about its respective pivot point to release said offshore platform jacket.

2. The method of claim 1 wherein each of said first and second lift rigging means comprises a spreader bar having at least one skid shoe attached to said spreader bar, at least two padeyes attached at opposite ends of said spreader bar, a lift sling attached to said padeyes, and at least two jacket support slings attached to said spreader bar.

3. The method of claim 2 wherein said at least one skid shoe of each of said first and second lift rigging means engages with said release means at a point outboard but near the pivot point for said release means.

4. The method of claim I wherein each of said first and second release means comprises at least one rocker beam, said rocker beam having a release-end, and a connector located at said release-end, for attaching said rocker beam to said vessel, said rocker beam adapted to pivot about said pivot point upon disengaging said connector.

5. The method of claim 3 wherein said connector comprises a latch.

6. The method of claim 3 wherein said connector comprises a shear plate attached to said vessel and released by shaped explosive charges.

7. The method of claim 3 wherein said connector comprises explosive bolts.

8. The method of claim 3 wherein each of said release means comprises two rocker beams.

9. The method of claim 1 wherein said vessel is a barge.

10. The method of claim 1 wherein said jacket first and second ends are lifted with a crane.

11. The method of claim 10 wherein said crane is mounted on a vessel.

12. The method of claim 1 wherein said jacket is positioned on its side on the ocean floor.

* * * * *